US009352759B2

(12) United States Patent
Ogawa

(10) Patent No.: US 9,352,759 B2
(45) Date of Patent: May 31, 2016

(54) CYLINDER DEVICE

(75) Inventor: Takayuki Ogawa, Tokyo (JP)

(73) Assignee: KAYABA INDUSTRY Co., LTD., Minato-ko, Tokyo (JP)

( * ) Notice: Subject to any disclaimer, the term of this patent is extended or adjusted under 35 U.S.C. 154(b) by 1032 days.

(21) Appl. No.: 13/063,608

(22) PCT Filed: Sep. 9, 2009

(86) PCT No.: PCT/JP2009/066049

§ 371 (c)(1),
(2), (4) Date: Apr. 29, 2011

(87) PCT Pub. No.: WO2010/030025

PCT Pub. Date: Mar. 18, 2010

(65) Prior Publication Data

US 2011/0192157 A1 Aug. 11, 2011

(30) Foreign Application Priority Data

Sep. 12, 2008 (JP) ..... 2008-234372

(51) Int. Cl.

| | |
|---|---|
| ***F15B 1/26*** | (2006.01) |
| ***B61F 5/24*** | (2006.01) |
| ***F15B 11/024*** | (2006.01) |
| ***F15B 13/02*** | (2006.01) |
| ***F15B 15/14*** | (2006.01) |
| ***F15B 21/14*** | (2006.01) |

(52) U.S. Cl.

CPC ..... *B61F 5/245* (2013.01); *F15B 11/024* (2013.01); *F15B 13/021* (2013.01); *F15B 15/149* (2013.01); *F15B 21/14* (2013.01); *F15B 2211/3058* (2013.01); *Y10T 137/87507* (2015.04)

(58) Field of Classification Search

CPC ..... F15B 11/024; F15B 13/021; F15B 2211/0358; B61F 5/245; F16K 17/048; F16K 17/06; Y10T 137/87507

USPC ..... 91/47, 48, 49, 157, 449, 416, 417 R, 91/437; 60/468; 137/601.14

See application file for complete search history.

(56) References Cited

U.S. PATENT DOCUMENTS 2,918,795 A * 12/1959 Marien ..... 60/475
4,049,017 A * 9/1977 Jones ..... 137/540
4,359,931 A * 11/1982 Palmersheim et al. ..... 91/436

(Continued)

FOREIGN PATENT DOCUMENTS

CN 1398735 A 2/2003
EP 1038750 A1 * 9/2000

(Continued)

*Primary Examiner* — Nathaniel Wiehe
*Assistant Examiner* — Logan Kraft
(74) *Attorney, Agent, or Firm* — McGlew and Tuttle, P.C.

(57) ABSTRACT

A cylinder device (1) according to the present invention includes: a cylinder (2); a piston (3) slidably inserted into the cylinder (2); a rod (4) inserted into the cylinder (2) and connected to the piston (3); a rod-side chamber (5) and a piston-side chamber (6) partitioned by the piston (3) within the cylinder (2); a first on-off valve (9) provided in the middle of a first passage (8) allowing the rod-side chamber (5) to communicate with the piston-side chamber (6); a second on-off valve (11) provided in the middle of a second passage (10) allowing the piston-side chamber (6) to communicate with the tank (7); and a pump (12) for supplying liquid to the rod-side chamber (5).

9 Claims, 6 Drawing Sheets

(56) References Cited

U.S. PATENT DOCUMENTS

| | | | | |
|---|---|---|---|---|
| 7,849,688 | B2 * | 12/2010 | Dvorak et al. | 60/456 |
| 2003/0234508 | A1 * | 12/2003 | Hanawa et al. | 280/272 |
| 2008/0209903 | A1 * | 9/2008 | Itoga et al. | 60/471 |

FOREIGN PATENT DOCUMENTS

| | | | | |
|---|---|---|---|---|
| GB | 2230876 | A | * | 10/1990 |
| JP | 162180/1975 | | | 6/1977 |
| JP | 62-292982 | A | | 12/1987 |
| JP | 6-117417 | A | | 4/1994 |
| JP | 8-26672 | A | | 1/1996 |
| JP | 2001-304205 | A | | 10/2001 |
| JP | 2003-139108 | A | | 5/2003 |
| JP | 2005-133902 | A | | 5/2005 |
| JP | 2005307794 | A | | 11/2005 |
| JP | 2006-137294 | | | 6/2006 |
| JP | 2007-131204 | A | | 5/2007 |
| JP | 2007-205416 | A | | 8/2007 |
| JP | 2007276532 | A | * | 10/2007 |

* cited by examiner

CYLINDER DEVICE

CROSS REFERENCE TO RELATED APPLICATIONS

This application is a United States National Phase application of International Application PCT/JP2009/066049 and claims the benefit of priority under 35 U.S.C. §119 of Japanese Patent Application No. 2008-234372 filed Sep. 12, 2008, the entire contents of which are incorporated herein by reference.

FIELD OF THE INVENTION

The present invention relates to an improved cylinder device.

BACKGROUND OF THE INVENTION

This type of cylinder devices is conventionally known to be applied to, for example, a railroad vehicle to suppress vibrations in lateral direction relative to an advancing direction of a vehicle body by being interposed between the vehicle body and a truck.

Such a cylinder device is disclosed, for example, in Japanese Patent Application Laid-Open No. 2005-7944 or 2006-137294, and is constituted as a double-rod type, including, as shown in FIG. 6, a cylinder 100, a piston 101 slidably inserted into the cylinder 100, a rod 102 inserted into the cylinder 100 with a middle portion thereof being connected to the piston 101, and a hydraulic circuit 105 for selectively supplying pressure oil to one of two working chambers 103 and 104 partitioned by the piston 101 within the cylinder 100.

More specifically, the hydraulic circuit 105 includes a two-way discharge pump 107 normally and reversely rotated by a motor 106, a pair of flow passages 108 and 109 connecting the pump 107 to the working chambers 103 and 104 respectively, on-off valves 110 and 111 provided respectively in the middle of the flow passages 108 and 109, an accumulator 112 performing volumetric compensation in oil temperature change or the like, and a low-pressure priority shuttle valve 113 connected to the flow passages 108 and 109 in parallel to the pump 107 to connect the low-pressure side of the working chambers 103 and 104 to the accumulator 112.

Therefore, when the rod 102 in this cylinder device is driven, for example, to the left, the pump 107 is driven to supply the pressure oil to the flow passage 109, and the on-off valves 110 and 111 are opened. The pressure oil is then supplied to the right working chamber 104 to press the piston 101 to the left, whereby the rod 102 is driven to the left. The rod 102 can be driven to the right by reversely rotating the pump 107.

SUMMARY OF THE INVENTION

According to the cylinder device disclosed in Japanese Patent Application Laid-Open No. 2005-7944 or 2006-137294 as described above, active control of suppressing vibrations of the vehicle body with exertion of thrust can be performed to secure a satisfactory ride quality.

However, the above-mentioned cylinder device must be configured to prevent both ends of the rod from submerging in the cylinder during stroking due to its double-rod structure, or the rod length (the axial length of the rod) must be set twice or more the cylinder length (the axial length of the cylinder) if the axial length of the piston and a rod guide provided at both ends of the cylinder to pivotally support the rod is ignored.

The resulting extended overall length of the cylinder device leads to a drawback in terms of mountability on various vehicles including railroad vehicle.

Further, although it is necessary to rapidly discharge gas within the working chambers out of the cylinder since entrapment of gas into the working chambers or penetration of gas which was originally blended into oil to the working chambers as bubbles during decompression disables development of on-target thrust due to the compressibility of the gas and causes deterioration of the responsiveness to thrust generation, the conventional cylinder device configured to simply introduce and discharge oil to and from each working chamber during operation has a structure difficult to spontaneously discharge the gas out of the working chambers by the operation of the device.

Therefore, the assembling process of the cylinder device requires consideration for high-level deaeration of the oil to be injected as occasion demands, in addition to assembling in oil or assembling under vacuumed environment and, at any rate, the cylinder device has a drawback on the productivity and requires an increased cost. Further, the cylinder device is forced to be periodically maintained, since the gas cannot be spontaneously discharged once entrapped into the working chambers as described above, and the only way to recover the performance is a maintenance involving disassembling or the like. Therefore, the cost burden can be increased also in terms of maintenance, in addition to the necessity of labor hour.

In the cylinder device, further, a low-pressure priority shuttle valve is provided within the circuit to avoid, in operation of the cylinder device, staying of pressure within the cylinder or negative pressure in the low-pressure side working chamber and further to stabilize the generated thrust by allowing the low-pressure side working chamber to communicate with an accumulator. However, the valve element of this low-pressure priority shuttle valve collides on a valve seat and rattles with each switching of the working direction of the cylinder device, and this harsh rattling noise can give a sense of discomfort or uneasiness to vehicle occupants.

Moreover, an expensive drive source is needed since high responsiveness in switching of rotating direction is required for the drive source of the pump which is driven in two ways, and the two-way discharge pump itself is also expensive since use of a pump which causes fluctuations of discharge capacity as little as possible in switching of rotating direction is needed to accurately suppress the vibration. Therefore, the overall economic efficiency of the cylinder device is also problematic.

The present invention has been achieved to improve the above-mentioned drawbacks, and one of the objects of the present invention is to improve the mountability on vehicles of a cylinder device. Another object of the present invention is to attain improvement in productivity and reduction in cost in terms of manufacturing and maintenance of the cylinder device. A further object of the present invention is to improve the calmness of the cylinder device, and an additional object of the present invention is to improve the economic performance of the cylinder device.

To attain the above-mentioned objects, a cylinder device according to the present invention includes: a cylinder; a piston inserted slidably into the cylinder; a rod inserted into the cylinder and connected to the piston; a rod-side chamber and a piston-side chamber partitioned by the piston within the cylinder; a tank; a first on-off valve provided in the middle of a first passage allowing the rod-side chamber to communicate with the piston-side chamber; a second on-off valve provided in the middle of a second passage allowing the piston-side chamber to communicate with the tank; and a pump for supplying liquid to the rod-side chamber.

According to the cylinder device of the present invention, the stroke length can be easily secured, compared with the double-rod cylinder device, since it is set to a single-rod type, and the overall length of the cylinder device can be reduced to improve the mountability on various vehicles including railroad vehicle.

Further, since the liquid supplied from the pump and carried by expanding and contracting operation in this cylinder device is circulated to successively pass through the rod-side chamber and the piston-side chamber and finally return to the tank, and gas, if entrapped into the rod-side chamber or the piston-side chamber, can be spontaneously discharged to the tank by the expanding and contracting action of the cylinder device, the deterioration of the responsiveness to thrust generation can be prevented.

Therefore, since the manufacture of the cylinder device can be performed without constraints as assembling in liquid or assembling under vacuumed environment, and the high-level deaeration of liquid is also dispensed with, the reduction in manufacturing cost can be attained in addition to the improvement in productivity.

Further, since the gas, even if entrapped into the rod-side chamber or the piston-side chamber, is spontaneously discharged to the tank by the extending and contracting operation of the cylinder device, frequent maintenance for performance recovery is also dispensed with, and the labor hour and cost burden in terms of maintenance can be also reduced.

Furthermore, since the liquid flow is circulated to successively pass through the rod-side chamber and the piston-side chamber and finally return to the tank as described above, staying of pressure within the rod-side chamber and the piston-side chamber is never caused, and the low-pressure priority shuttle valve for thrust stabilization is dispensed with. Consequently, the cylinder device is improved in the calmness without the problem of rattling of the low-pressure priority shuttle valve, and can be mounted on a vehicle without giving a sense of unpleasant or uneasiness to the vehicle occupants.

Additionally, since the pump discharges only in one direction without capacitive fluctuations in rotation switching, an inexpensive pump can be employed, and since the high responsiveness in switching of rotating direction is not required for the motor that is the driving source of the pump, an inexpensive motor can be employed. Consequently, the cylinder device is reduced in the cost as the whole, and improved in the economic efficiency.

This cylinder device, when forcedly extended and contracted by external force, can behave as a damper by stopping the drive of the pump, and can suppress the vibration of a vibration control object by semiactive control typified by skyhook semiactive control, as well as suppressing the vibration of the vibration control object by the active control by the behavior as actuator. Thus, since the cylinder device can be controlled by selecting, of the active control and the semiactive control, the one most suitable to vibration suppression according to the vibration mode, the vibration suppressing effect on the vibration control object is improved.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
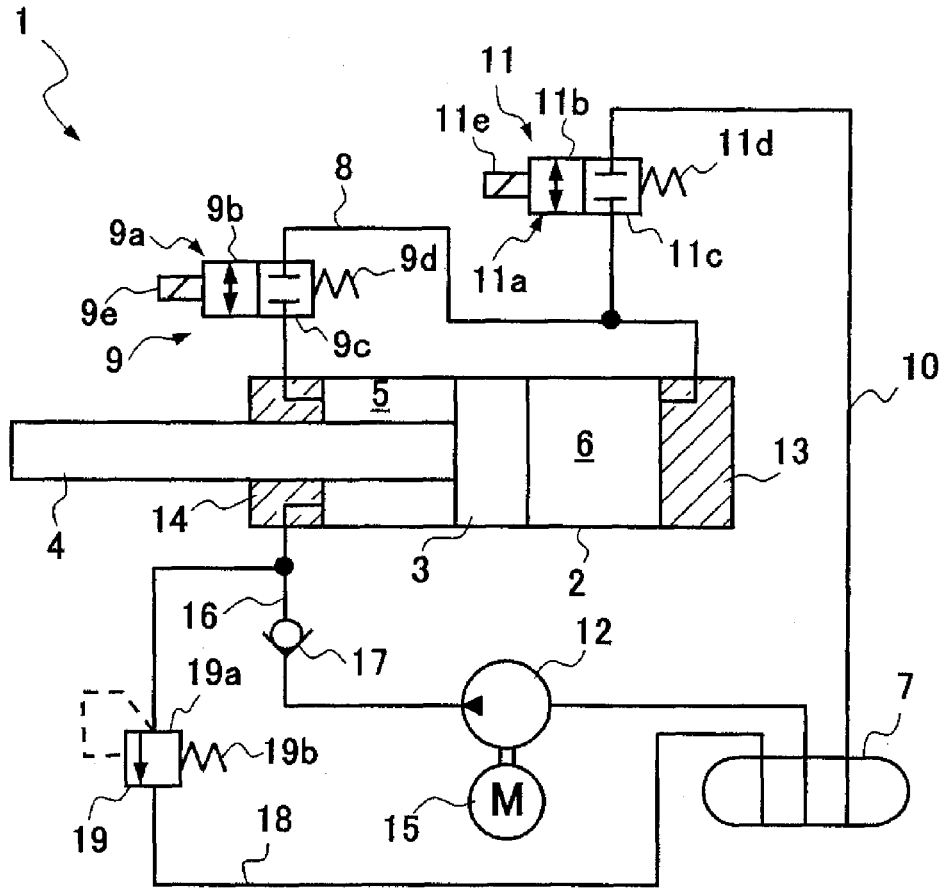
FIG. 1 is a circuit diagram of a cylinder device according to one embodiment of the present invention.

A cylinder device 1 according to one embodiment is basically constituted as a single-rod cylinder device, as shown in FIG. 1, which includes a cylinder 2; a piston 3 inserted slidably into the cylinder 2; a rod 4 inserted into the cylinder 2 and connected to the piston 3; a rod-side chamber 5 and a piston-side chamber 6 partitioned by the piston 3 within the cylinder 2; a tank 7; a first on-off valve 9 provided in the middle of a first passage 8 allowing the rod-side chamber 5 to communicate with the piston-side chamber 6; a second on-off valve 11 provided in the middle of a second passage 10 allowing the piston-side chamber 6 to communicate with the tank 7; and a pump 12 for supplying liquid to the rod-side chamber 5. The rod-side chamber 5 and the piston-side chamber 6 are filled with liquid such as hydraulic oil, and the tank 7 is filled with gas in addition to the liquid. The inside of the tank 7 does not have to be in a pressurized state particularly by filling the gas with pressure.

Basically, the cylinder device 1 can be driven to extend by laying the first passage 8 in a communicating state by the first on-off valve 9 and driving the pump 12 with the second on-off valve 11 being closed, and the cylinder device 1 can be driven to contract by laying the second passage 10 in a communicating state and driving the pump 12 with the first on-off valve 9 being closed.

Each of components of the cylinder device will be then described in detail. The cylinder 2 has a cylindrical shape with the right end in FIG. 1 being closed by a lid 13, and an annular rod guide 14 being attached to the left end in FIG. 1. The rod 4 to be inserted movably into the cylinder 2 is inserted slidably into the rod guide 14. One end of the rod 4 is protruded out of the cylinder 2, and the other end within the cylinder 2 is connected to the piston 3 similarly inserted slidably into the cylinder 2.

The gap between the outer circumference of the rod 4 and the cylinder 2 is sealed by a seal member not shown, whereby the inside of the cylinder 2 is maintained in a sealed state. The rod-side chamber 5 and the piston-side chamber 6 partitioned by the piston 3 within the cylinder 2 are filled with hydraulic oil as the liquid as described above.

In this cylinder device 1, the sectional area of the rod 4 is set to a half of the sectional area of the piston 3, so that the pressure receiving area on the rod-side chamber 5 side in the piston 3 is a half of the pressure receiving area on the piston-side chamber 6 side. Thus, if the pressure of the rod-side chamber 5 is the same in both extending drive and contracting drive, thrust forces generated by both extension and contraction are equal to each other, and the flow rate to the displacement of the cylinder device 1 is also equalized on both extension and contraction sides.

More specifically, when the cylinder device 1 is driven to extend, the rod-side chamber 5 is in communication with the piston-side chamber 6 to equalize the pressures within the rod-side chamber 5 and the piston-side chamber 6 to each other, and a thrust obtained by multiplying the pressure receiving area difference between the rod-side chamber 5 side and the piston-side chamber 6 side in the piston 3 by the above-mentioned pressure is generated, and when the cylinder device 1 is driven to contract reversely, a thrust obtained by multiplying the pressure of the rod-side chamber 5 by the pressure receiving area on the rod-side chamber 5 side in the piston 3 is generated since the communication between the rod-side chamber 5 and the piston-side chamber 6 is interrupted, and the piston-side chamber 6 is in communication with the tank 7. The generated thrust of the cylinder device 1 thus corresponds to a value obtained by multiplying a half of the sectional area of the piston 3 by the pressure of the rod-side chamber 5 in both the extension and the contraction. Therefore, the thrust of the cylinder device 1 can be controlled by controlling the pressure of the rod-side chamber 5 in both the extending drive and the contracting drive. In that regard, since the pressure receiving area on the rod-side chamber 5 side in the piston 3 is set to a half of the pressure receiving area on the piston-side chamber 6 side, the following advantages are provided: the control is simplified when the same thrust is generated on both extending side and contracting side since the pressure of the rod-side chamber 5 is the same on both the extending side and the contracting side and, in addition, the same responsiveness is secured on both the extending side and contracting side since the flow rate to displacement is the same. Even if the pressure receiving area on the rod-side chamber 5 side in the piston 3 is not set to a half of the pressure receiving area on the piston-side chamber 6 side, the thrusts on both the extending and contracting sides of the cylinder device 1 can be controlled by the pressure of the rod-side chamber 5.

A lid 13 for closing the left end of the rod 4 and the right end of the cylinder 2 in FIG. 1 includes an attachment portion not shown, so that the cylinder device 1 can be interposed between a vehicle body and an axle in a vehicle.

The rod-side chamber 5 and the piston-side chamber 6 are allowed to communicate with each other by the first passage 8, and the first on-off valve 9 is provided in the middle of the first passage 8. The first passage 8 may be provided in the piston 3 although the communication between the rod-side chamber 5 and the piston-side chamber 6 is performed outside the cylinder 2.

The first on-off valve 9 is composed of a solenoid on-off valve in this embodiment, including a valve 9*a* which includes a communicating position 9*b* for opening the first passage 8 to allow the rod-side chamber 5 to communicate with the piston-side chamber 6 and an interrupting position 9*c* for interrupting the communication of the rod-side chamber 5 with the piston-side chamber 6; a spring 9*d* which biases the valve 9*a* so as to be located at the interrupting position 9*c*; and a solenoid 9*e* which switches the valve 9*a* to the communicating position 9*b* against the spring 9*d* in current-carrying.

The piston-side chamber 6 and the tank 7 are allowed to communicate with each other by the second passage 10, and the second on-off valve 11 is provided in the middle of the second passage 10. The second on-off valve 11 is composed of a solenoid on-off valve in this embodiment, including a valve 11*a* which includes a communicating position 11*b* for opening the second passage 10 to allow the piston-side chamber 6 to communicate with the tank 7 and an interrupting position 11*c* for interrupting the communication of the piston-side chamber 6 with the tank 7; a spring 11*d* which biases the valve 11*a* so as to be located at the interrupting position 11*c*; and a solenoid 11*e* which switches the valve 11*a* to the communicating position 11*b* against the spring 11*d* in current•carrying.

The pump 12 is driven by a motor 15 in this embodiment. The pump 12 is configured to discharge liquid only in one direction with a discharge port being allowed to communicate with the rod-side chamber 5 by a supply passage 16 and a suction port being allowed to communicate with the tank 7, so that it sucks, when driven by the motor 15, liquid from the tank 7 and discharges the liquid to the rod-side chamber 5. The pump 12 is free from problems such as the change in discharge quantity in rotation switching since it only discharges the liquid in one direction without the switching operation of rotating direction as described above, and an inexpensive gear pump or the like can be employed. Further, since the rotating direction of the pump 12 is regularly constant, no high responsiveness to rotation switching is required for the motor 15 as the drive source for driving the pump 12, and an inexpensive one can be used as the motor 15 to this extent.

A check valve 17 is provided in the middle of the supply passage 16 to arrest the backflow of the liquid from the rod-side chamber 5 to the pump 12.

In this embodiment, the rod-side chamber 5 is connected to the tank 7 through a passage 18, and a relief valve 19 is provided in the middle of the passage 18 to open the passage 18 at a preset valve opening pressure.

The relief valve 19 is configured so that, when the pressure of the rod-side chamber 5 on the upstream side of the passage 18 to be applied onto a valve element 19*a* exceeds the valve opening pressure, a thrust resulting from the above-mentioned pressure which presses the valve element 19*a* in the direction of opening the passage 18 overcomes the biasing force of the spring 19*b* biasing the valve element 19*a* in the direction of interrupting the passage 18 to retreat the valve element 19*a*, whereby the passage 18 is opened.

The relief valve 19 opens the passage 18, if the pressure of the rod-side chamber 5 exceeds the valve opening pressure due to an extending/contracting-directional excessive input to the cylinder device 1, regardless of the opening and closing state of the first on-off valve 9 and the second on-off valve 11, to allow the rod-side chamber 5 to communicate with the tank 7, whereby the pressure within the rod-side chamber 5 is released to the tank 7 to protect the overall system of the cylinder device 1.

The operation of the thus-constituted cylinder device 1 will be then described.

When the cylinder device 1 is operated as actuator, thrusts on both extending and contracting sides of the cylinder device 1 can be controlled by controlling the pressure of the rod-side chamber 5 as described above.

As one of concrete methods, the thrust of the cylinder device 1 can be controlled to a desired value by on/off-controlling the first on-off valve 9 and the second on-off valve 11 to adjust the pressure of the rod-side chamber 5.

If a desired extending directional thrust is to be obtained while extending the cylinder device 1, for example, the motor 15 is driven with the first on-off valve 9 being at the communicating position 9*b* to supply the liquid from the pump 12 into the cylinder 2. Thus, the liquid is supplied from the pump 12 to both the rod-side chamber 5 and the piston-side chamber 6 which are in communication with each other to press the piston 3 to the left in FIG. 1, whereby the cylinder device 1 develops extending operation. Along with this operation, the second on-off valve 11 is opened and closed to adjust the pressure of the rod-side chamber 5 so that the value obtained by multiplying the pressure of the rod-side chamber 5 by the pressure receiving area difference between the piston-side chamber 6 side and the rod-side chamber 5 side in the piston 3 is equalized to the desired thrust. Since the pressure of the piston-side chamber 6 is equal to the pressure of the rod-side chamber 5, the pressure of the piston-side chamber 6 is also controlled by controlling the pressure of the rod-side chamber 5.

That is, the thrust in the extending direction of the cylinder device 1 can be obtained as designed by opening the second on-off valve 11, when the pressure of the rod-side chamber 5 is too high to obtain the desired thrust, to release the pressures of the piston-side chamber 6 and the rod-side chamber 5 to the tank 7, and closing the second on-off valve 11, when the pressure of the rod-side chamber 5 is too low to obtain the desired thrust to the contrary, to raise the pressures of the piston-side chamber 6 and the rod-side chamber 5 through the liquid supply from the pump 12. Therefore, this control can be performed by sensing the pressure of only the rod-side chamber 5.

Further, even as the contraction of the cylinder device 1 by external force, a desired extending-directional thrust opposing it can be obtained by on/off-controlling the second on-off valve 11 in a state where the liquid is supplied from the pump 12 into the cylinder 2 by driving the motor 15 with the first on-off valve 9 being at the communicating position 9*b* similarly to the case where the extending-directional thrust is obtained with extension. Since the cylinder device 1 is in a state in which it exerts no thrust more than external force in this case, it is only necessary to cause the cylinder device 1 to function as damper. Therefore, the desired thrust can be obtained even by on/off-controlling the second on-off valve 11 with the first on-off valve 9 being at the communicating position 9*b* while stopping the liquid supply from the pump 12.

On the other hand, if a desired contracting-directional thrust is to be obtained while contracting the cylinder device 1, the motor 15 is driven with the second on-off valve 11 being at the communicating position 11*b* to supply the liquid from the pump 12 into the cylinder 2. Along with this operation, the first on-off valve 9 is opened and closed to adjust the pressure of the rod-side chamber 5 so that the value obtained by multiplying the pressure of the rod-side chamber 5 by the pressure receiving area of the rod-side chamber 5 side in the piston 3 is equalized to the desired thrust.

That is, the thrust in the extending direction of the cylinder device 1 can be obtained as designed by opening the first on-off valve 9, when the pressure of the rod-side chamber 5 is too high to obtain a desired thrust, to release the pressure of the rod-side chamber 5 to the tank 7 through the opened second passage 10, and closing the first on-off valve 9, when the pressure of the rod-side chamber 5 is too low to obtain the desired thrust to the contrary, to raise the pressure of the rod-side chamber 5 through the liquid supply from the tank 12.

Further, even as the extension of the cylinder device 1 by external force, a desired contracting-directional thrust opposing it can be obtained by on/off-controlling the first on-off valve 11 in a state where the liquid is supplied from the pump 12 into the cylinder 2 by driving the motor 15 with the second on-off valve 11 being at the communicating position 11*b* to supply the liquid from the pump 12 into the cylinder 2, similarly to the case where the contracting-directional thrust is obtained with contraction. In this case, since the cylinder device 1 is in a state where it exerts no thrust more than external force, it is only necessary to cause the cylinder device 1 to function as damper. Therefore, the desired thrust can be obtained even by on/off-controlling the first on-off valve 9 with the second on-off valve 11 being at the communicating position 11*b* while interrupting the liquid supply from the pump 12.

The cylinder device 1 fulfills the function as actuator in this manner. Since this cylinder device 1 is set to the single-rod type, the stroke length can be easily secured, compared with the double-rod cylinder device, and the overall length of the cylinder device can be reduced to improve the mount ability on various vehicles including railroad vehicle.

Since the liquid flow supplied from the pump 12 and carried by extending and contracting operation in this cylinder device 1 is circulated to successively pass through the rod-side chamber 5 and the piston-side chamber 6 and finally return to the tank 7, and gas, even if entrapped into the rod-side chamber 5 or the piston-side chamber 6, can be spontaneously discharged to the tank 7 by the expanding and contracting operation of the cylinder device 1, the deterioration of the responsiveness to thrust generation can be prevented.

Accordingly, since the manufacture of the cylinder device 1 can be performed without constraints such as assembling in liquid or assembling under vacuumed environment, and the high-level deaeration of liquid is also dispensed with, the reduction in manufacturing cost can be attained in addition to the improvement in productivity.

Further, since the gas, even if entrapped into the rod-side chamber 5 or the piston-side chamber 6, is spontaneously discharged to the tank 7 by the extending and contracting operation of the cylinder device 1, frequent maintenance for performance recovery is also dispensed with, and the labor hour and cost burden in terms of maintenance can be reduced.

Furthermore, since the liquid flow is circulated to successively pass through the rod-side chamber 5 and the piston-side chamber 6 and finally return to the tank 7 as described above, staying of pressure within the rod-side chamber 5 and the piston-side chamber 6 is never caused, and the low-pressure priority shuttle valve for thrust stabilization is dispensed with. Consequently, the cylinder device 1 is improved in the calmness without the problem of rattling of the low-pressure priority shuttle valve, and can be mounted on a vehicle without giving a sense of unpleasant or uneasiness to the vehicle occupants.

Additionally, since the pump 12 discharges only in one direction without capacitive fluctuations in rotation switching, an inexpensive pump 12 can be employed, and since the high responsiveness in switching of rotating direction is not required for the motor 15 that is the driving source of the pump 12, an inexpensive motor 15 can be employed. Consequently, the cylinder device 1 is reduced in the cost as the whole, and improved in the economic efficiency.

This cylinder device 1, when forcedly extended and contracted by external force, can behave as a damper by stopping the drive of the pump 12, and can suppress the vibration of a vibration control object by semiactive control typified by skyhook semiactive control, as well as suppressing the vibration of the vibration control object by the active control by the behavior as actuator. Thus, since the cylinder device 1 can be controlled by selecting, of the active control and the semiactive control, the one most suitable to vibration suppression according to the vibration mode, the vibration suppressing effect on the vibration control object is improved. When the cylinder device 1 is operated as the damper to execute the skyhook semiactive control, the cylinder device 1 is controlled to exert a thrust obtained by multiplying a skyhook damping factor by a relative speed of the cylinder 2 and the rod 4 of the cylinder device 1 when the vibrating direction of the vibration control object is matched to the relative direction of the cylinder device 1, and to minimize the thrust of the cylinder device 1 as much as possible when the vibrating direction of the vibration control object is differed from the relative direction of the cylinder device 1. Thus, the control can be performed by on/off-controlling the first on-off valve 9 and the second on-off valve 11 so as to satisfy the above-mentioned condition, and the thrust of the cylinder device 1 can be minimized by locating both the first on-off valve 9 and the second on-off valve 11 at the communicating positions 9*b* and 11*b*.

In this embodiment, further, since the check valve 17 is provided in the middle of the supply passage 16 on the downstream of the pump 12, the backflow of the liquid from the rod-side chamber 5 to the pump 12 is arrested even if the cylinder device 1 is forcedly extended and contracted by external force. Thus, even in a situation such that the torque of the motor M is insufficient for the thrust, a thrust more than the thrust by the torque of the motor M can be obtained by opening and closing the first on-off valve 9 and the second on-off valve 11 to operate the cylinder device 1 as damper.

Figure 2:
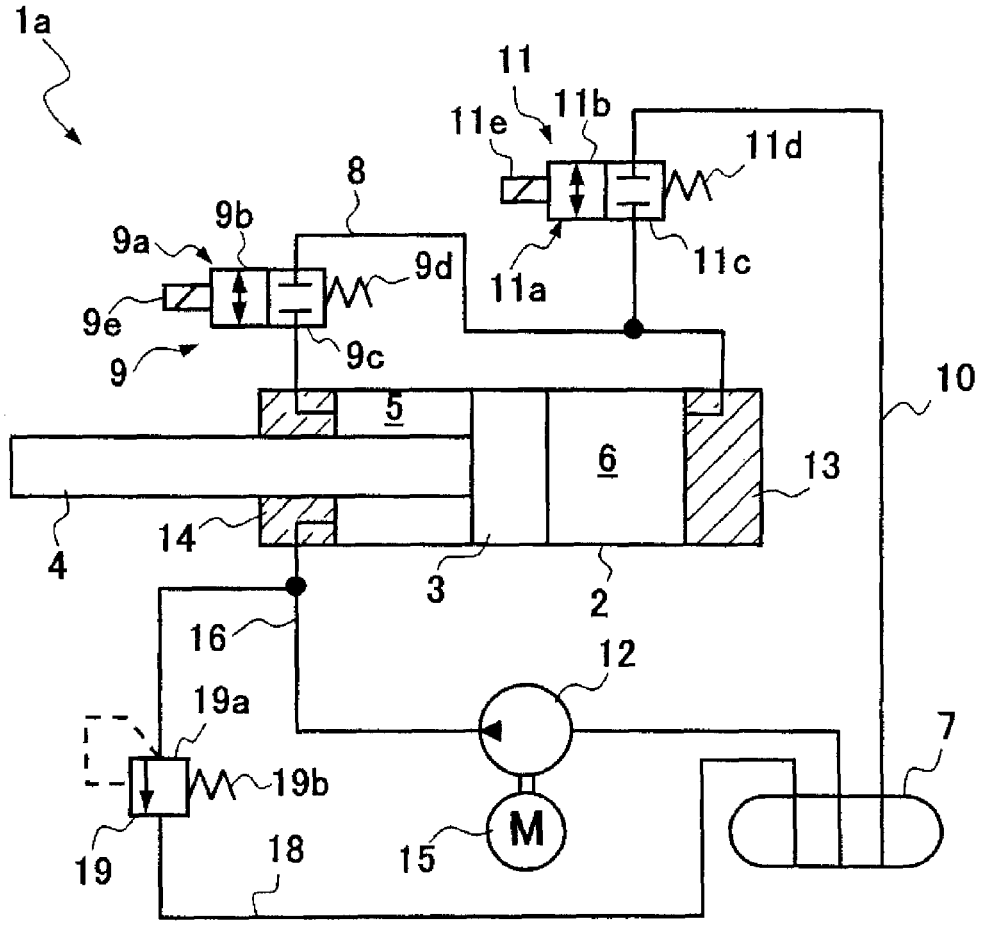
FIG. 2 is a circuit diagram of a cylinder device according to a modified example of the one embodiment.

As the second of concrete methods for operating the cylinder device as actuator, the thrust of the cylinder device can be controlled to a desired value by adjusting the pressure of the rod-side chamber 5 through control of the torque of the motor 15. In this case, the check valve 17 provided in the supply passage 16 can be abolished as in a cylinder device 1*a* as one modified example of the one embodiment shown in FIG. 2.

If a desired extending-directional thrust force is to be obtained while extending the cylinder device 1*a*, the motor 15 is driven with the first on-off valve 9 being at the communicating position 9*b* and the second on-off valve 11 being at the interrupting position 11*c* to supply the liquid from the pump 12 into the cylinder 2. Thus, the liquid is supplied from the pump 12 to both the rod-side chamber 5 and the piston-side chamber 6 which are in communication with each other to press the piston 3 to the left in FIG. 2, whereby the cylinder device 1*a* develops extending operation. Along with this operation, the torque of the motor 15 is adjusted to control the pressure of the rod-side chamber 5 so that the value obtained by multiplying the pressure of the rod-side chamber 5 by the pressure receiving area difference between the piston-side chamber 6 side and the rod-side chamber 5 side in the piston 3 is equalized to the desired thrust. In this case, since the pump 12 is driven by the torque of the motor 15, and receives the pressure of the rod-side chamber 5, the pressure of the rod-side chamber 5 can be controlled by adjusting the torque of the motor 15 which is proportional to the discharge pressure of the pump 12.

That is, the thrust in the extending direction of the cylinder device 1*a* can be obtained as designed by reducing the torque of the motor 15, when the pressure of the rod-side chamber 5 is too high to obtain a desired thrust, to reduce the pressure of the rod-side chamber 5, and increasing the torque of the motor 15, when the pressure of the rod-side chamber 5 is too low to obtain the desired thrust to the contrary, to raise the pressure of the piston-side chamber 6 and the rod-side chamber 5. Thus, this control can performed by directly sensing the torque of the motor 15 or sensing the current carried to a winding wire of the motor 15 to obtain the generation torque of the motor 15.

Further, even as the contraction of the cylinder device 1*a* by external force, a desired extending-directional thrust opposing it can be obtained by adjusting the torque of the motor 15 with the first on-off valve 9 being at the communicating position 9*b* and the second on-off valve 11 being at the interrupting position 11*c*, similarly to the case where the extending-directional thrust is obtained with extension. In this case, the motor 15 is never driven to reversely rotate since the motor 15 is regularly instructed to normally rotate the pump 12 in spite of the reverse rotation of the motor 15 and the pump 12. Further, since the cylinder device 1*a* is in a state where it exerts no thrust more than external force, it is only necessary to cause the cylinder device 1*a* to function as damper. Therefore, the desired thrust can be obtained even by on/off-controlling the second on-off valve 11 with the first on-off valve 9 being at the communicating position 9*b* while interrupting the liquid supply from the pump 12.

On the other hand, if a desired contracting-directional thrust is to be obtained while contracting the cylinder device 1*a*, the motor 15 is driven with the first on-off valve 9 being at the interrupting position 9*c* and the second on-off valve 11 being at the communicating position 11*b* to supply the liquid from the pump 12 into the cylinder 2. Along with this operation, the torque of the motor 15 is adjusted to control the pressure of the rod-side chamber 5 so that the value obtained by multiplying the pressure of the rod-side chamber 5 by the pressure receiving area on the rod-side chamber 5 side in the piston 3 is equalized to the desired thrust.

That is, the thrust in the contracting direction of the cylinder device 1*a* can be obtained as designed by reducing the torque of the motor 15, when the pressure of the rod-side chamber 5 is too high to obtain the desired thrust, to reduce the pressure of the rod-side chamber 5, and increasing the torque of the motor 15, when the pressure of the rod-side chamber 5 is too small to obtain the desired thrust, to raise the pressure of the rod-side chamber 5.

Further, even as the extension of the cylinder device 1*a* by external force, a desired contracting-directional thrust force opposing it can be obtained by adjusting the torque of the motor 15 with the first on-off valve 9 being at the interrupting position 9*c* and the second on-off valve 11 being at the communicating position 11*b*, similarly to the case where the contracting-directional thrust is obtained with contraction. In this case, since the cylinder device 1*a* in a state where it exerts no thrust more than external force, it is only necessary to cause the cylinder device 1*a* to function as damper. Therefore, the desired thrust force can be obtained even by on/off-controlling the first on-off valve 9 with the second on-off valve 11 being at the communicating position 11*b* while interrupting the liquid supply from the pump 12.

In the above-mentioned control, when the cylinder device 1*a* is set to necessarily behave as the damper with the extending and contracting direction of the cylinder device 1*a* being reverse to the direction of thrust, the check valve 17 provided in the supply passage 16 does not have to be abolished since it is better to arrest the backflow of liquid to the pump 12, and this control can be applied also to a one provided with the check valve 17 as the cylinder device 1 shown in FIG. 1.

The cylinder device 1*a* can fulfill the function as actuator also by controlling the torque of the motor 15, and can produce various function effects in the cylinder device 1 of the one embodiment described above since it has the same principle of thrust generation with increased variations of control method.

This cylinder device 1*a* also, when forcedly extended and contracted by external force, can behave as a damper and can suppress the vibration of a vibration control object by semiactive control, as well as suppressing the vibration of the vibration control object by the active control by the behavior as actuator.

Figure 3:
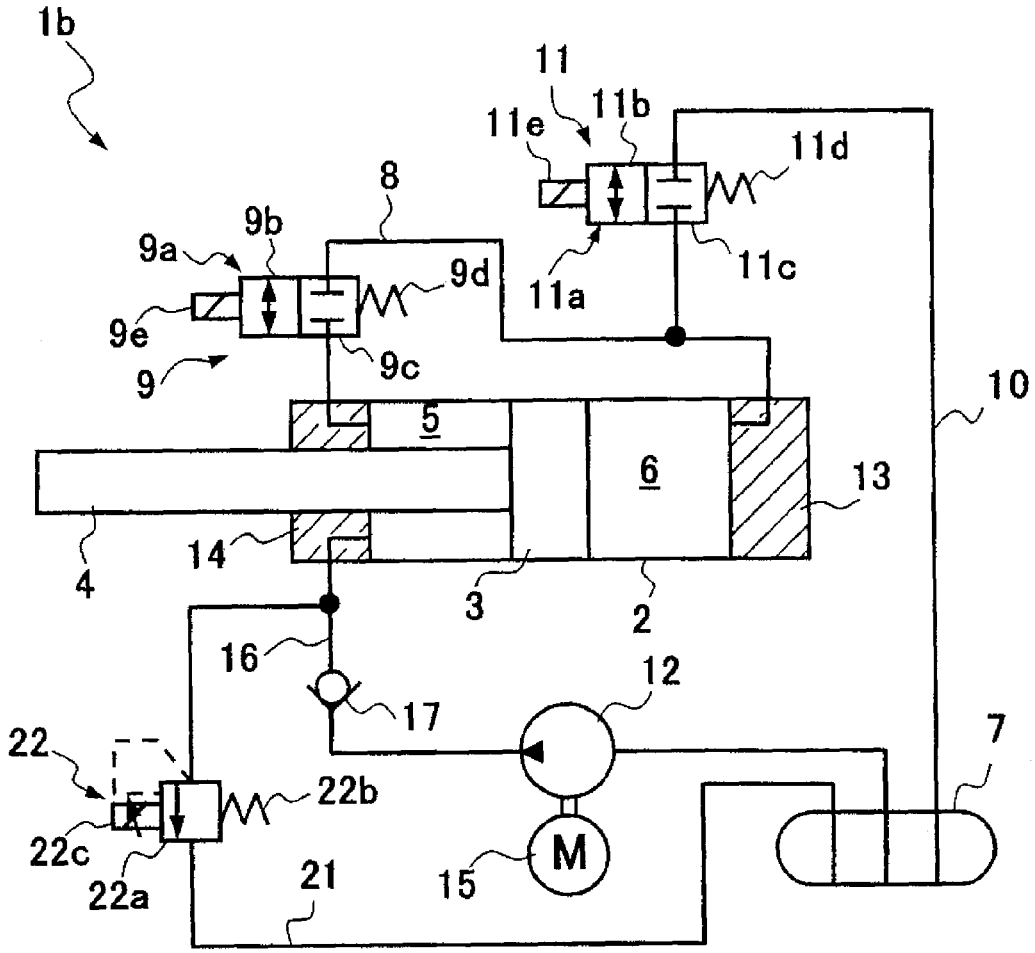
FIG. 3 is a circuit diagram of a cylinder device in another modified example of the one embodiment.

Next, a cylinder device 1*b* as the other modified example of the one embodiment shown in FIG. 3 is described. In the cylinder device 1*b* of the other modified example, the passage 18 and the relief valve 19 in the cylinder device 1 of the one embodiment are abolished, the rod-side chamber 5 is connected to the tank 7 through a discharge passage 21 instead, and a variable relief valve 22 capable of changing valve opening pressure is provided in the middle of the discharge passage 21.

The variable relief valve 22 includes a valve element 22*a* provided in the middle of the discharge passage 21; a spring 22*b* which biases the valve element 22*a* to interrupt the discharge passage 21; and a proportional solenoid 22*c* which generates a thrust opposed to the spring 22*b* in current-carrying, and can adjust the valve opening pressure by adjusting the current to be carried to the proportional solenoid 22*c*.

The variable relief valve 22 is configured so that, when the pressure of the rod-side chamber 5 on the upstream side of the discharge passage 21 to be applied onto the valve element 22*a* exceeds a relief pressure, the resultant force of a thrust resulting from the above-mentioned pressure which presses the valve element 22*a* in the direction of opening the discharge passage 21 and a thrust by the proportional solenoid 22*c* overcomes the biasing force of the spring 22*b* biasing the valve element 22*a* in the direction of interrupting the discharge passage 21 to retreat the valve element 22*a*, whereby the discharge passage 21 is opened.

In the variable relief valve 22, the thrust generated by the proportional solenoid 22*c* can be increased by increasing the amount of current to be supplied to the proportional solenoid 22*c*, and the valve opening pressure is minimized when the current is supplied to the proportional solenoid 22*c* to a maximum extent, and maximized when no current is supplied to the proportional solenoid 22*c*.

The variable relief valve 22 is configured to open the discharge passage 21, if the pressure of the rod-side chamber 5 exceeds the valve opening pressure due to excessive extending-directional input to the cylinder device 1*b*, regardless of the opening and closing state of the first on-off valve 9 and the second on-off valve 11, to allow the rod-side chamber 5 to communicate with the tank 7 to release the pressure in the rod-side chamber 5 to the tank 7, whereby the overall system of the cylinder device 1 is protected.

Since the cylinder device 1*b* of this embodiment is provided with the variable relief valve 22, the thrust of the cylinder device 1, when caused to operate as actuator, can be controlled by controlling the pressure of the rod-side chamber 5 through adjustment of the valve opening pressure of the variable relief valve 22, in addition to the above-mentioned two concrete methods. That is, the pressure of the rod-side chamber 5 is controlled by the variable relief valve 22, and the direction of thrust is determined by the first on-off valve 9 and the second on-off valve 11.

If a desired extending-directional thrust is to be obtained while extending the cylinder device 1*b*, for example, the motor 15 is driven with the first on-off valve 9 being at the communicating position 9*b* and the second on-off valve 11 being at the interrupting position 11*c* to supply the liquid from the pump 12 into the cylinder 2. Along with this operation, the current of the proportional solenoid 22*c* is adjusted to control the valve opening pressure so that the value obtained by multiplying the valve opening pressure of the variable relief valve 22 by the pressure receiving area difference between the piston-side chamber 6 side and the rod-side chamber 5 side in the piston 3 is equalized to the desired thrust.

That is, since the variable relief valve 22 is opened, when the pressure of the rod-side chamber 5 that is equal to the pressure of the piston-side chamber 6 exceeds the valve opening pressure of the variable relief valve 22, to release the pressures of the piston-side chamber 6 and the rod-side chamber 5 to the tank 7, and the variable relief valve 22 is closed, when the pressure of the rod-side chamber 5 is below the valve opening pressure of the variable relief valve 22, to raise the pressure of the piston-side chamber 6 and the rod-side chamber 5 through the liquid supply from the pump 12, the pressure of the piston-side chamber 6 and the rod-side chamber 5 is consequently controlled to the valve opening pressure of the variable relief valve 22, whereby the thrust in the extending direction of the cylinder device 1 can be obtained as designed. Thus, this control can be performed by acquiring a relationship between the current of the proportional solenoid 22*c* and the valve opening pressure in the variable relief valve 22, and open-loop control can be performed. Further, feedback control may be performed by use of a current loop while sensing the current-carrying amount to the proportional solenoid 22*c*, and the feedback control can be performed also by sensing the pressure of the rod-side chamber 5.

Further, even as the contraction of the cylinder device 1*b* by external force, a desired extending-directional thrust opposing it can be obtained by adjusting the valve opening pressure of the variable relief valve 22 in a state where the liquid is supplied from the pump 12 into the cylinder 2 by driving the motor 15 with the first on-off valve 9 being at the communicating position 9*b* and the second on-off valve 11 being at the interrupting position 11*c*, similarly to the case where the extending-directional thrust is obtained with extension. In this case, since the cylinder device 1*b* is in a state where it exerts no thrust more than external force, it is only necessary to cause the cylinder device 1*b* to function as damper. Therefore, the desired thrust can be obtained even by controlling the valve opening pressure of the variable relief valve 22 with the first on-off valve 9 being at the communicating position 9*b* and the second on-off valve 11 being at the interrupting position 11*c* while interrupting the liquid supply from the pump 12.

On the other hand, if a desired contracting-directional thrust is to be obtained while contracting the cylinder device 1*b*, the motor 15 is driven with the first on-off valve 9 being at the interrupting position 9*c* and the second on-off valve 11 being at the communicating position 11*b* to supply the liquid from the pump 12 into the cylinder 2. Along with this operation, the amount of current of the proportional solenoid 22*c* is adjusted to control the valve opening pressure so that the value obtained by multiplying the valve opening pressure of the variable relief valve 22 by the pressure receiving area on the rod-side chamber 5 side in the piston 3 is equalized to the desired thrust.

That is, since the variable relief valve 22 is opened, when the pressure of the rod-side chamber 5 exceeds the valve opening pressure of the variable relief valve 22, to release the pressure to the tank 7, and the variable relief valve 22 is closed, when the pressure of the rod-side chamber 5 is below the valve opening pressure of the variable relief valve 22, to raise the pressure of the rod-side chamber 5 through the liquid supply from the pump 12, the pressure of the rod-side chamber 5 is consequently controlled to the valve opening pressure of the variable relief valve 22, whereby the thrust in the extending direction of the cylinder device 1*b* can be obtained as designed. The piston-side chamber 6 never interferes with the contracting operation of the cylinder device 1*b* since it is allowed to communicate with the tank 7 by the communicating position 11*b* of the second on-off valve 11.

Further, even as the extension of the cylinder device 1*b* by external force, a desired contracting-directional thrust opposing it can be obtained by adjusting the valve opening pressure of the variable relief valve 22 in a state where the liquid is supplied from the pump 12 into the cylinder 2 by driving the motor 15 with the first on-off valve 9 being at the interrupting position 9*c* and the second on-off valve 11 being at the communicating position 11*b*, similarly to the case where the contracting-directional thrust is obtained with contraction. In this case, since the cylinder device 1*b* is in a state where it exerts no thrust more than external force, it is only necessary to cause the cylinder device 1*b* to function as damper. Therefore, the desired thrust can be obtained even by controlling the valve opening pressure of the variable relief valve 22 with the first on-off valve 9 being at the interrupting position 9*c* and the second on-off valve 11 being at the communicating position 11*b* while interrupting the liquid supply from the pump 12.

In the cylinder device 1*b* of the other modified example, since the variable relief valve 22 is provided in the middle of the discharge passage 21 allowing the rod-side chamber 5 to communicate with the tank 7, the thrust can be controlled by controlling the valve opening pressure of the variable relief valve 22, in addition to the control methods of the cylinder devices 1 and 1*a* of the one embodiment and the one modified example thereof, so that the function as actuator can be fulfilled. The cylinder device 1*b* can provide various function effects in the cylinder device 1 of the above-mentioned embodiment since it has the same principle of thrust generation with increased variations of the control method.

Additionally, since the magnitude of thrust can be controlled by controlling the valve opening pressure of the variable relief valve 22, the advantage that the thrust of the cylinder device 1*b* can be adjusted, without particular sensing of other state quantities, only by acquiring the amount of current to be supplied to the proportional solenoid 22*c* and the valve opening pressure can be enjoyed.

Further, this cylinder device 1*b* also, when forcedly extended and contracted by external force, can behave as a damper by stopping the drive of the pump 12 to adjust the thrust by controlling the valve opening pressure of the variable relief valve 22, and thus can suppress the vibration of the vibration control object by skyhook semiactive control, as well as suppressing the vibration of the vibration control object by the active control by the behavior as actuator. In the skyhook semiactive control, the thrust of the cylinder device 1*b* can be minimized by locating both the first on-off valve 9 and the second on-off valve 11 at the communicating positions 9*b* and 11*b*.

Figure 4:
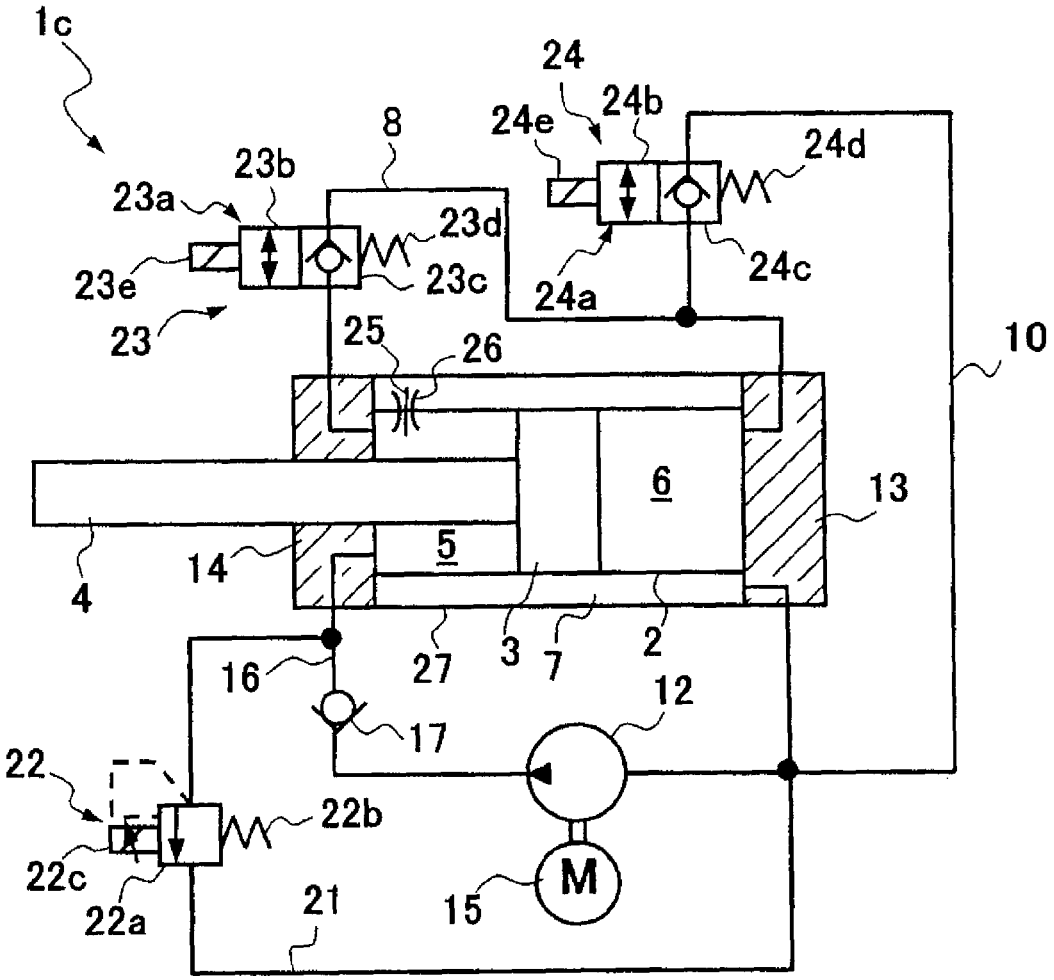
FIG. 4 is a circuit diagram of a cylinder device in an additional modified example of the one embodiment.

Successively, a cylinder device 1*c* as an additional modified example of the one embodiment shown in FIG. 4 is described. In this cylinder device 1*c*, the first on-off valve 9 and the second on-off valve 11 of the cylinder device 1*b* of the other modified example of the one embodiment are replaced by a first on-off valve 23 and a second on-off valve 24 respectively.

The first on-off valve 23 is composed of a solenoid on-off valve in this embodiment, including a valve 23*a* including a communicating position 23*b* for opening the first passage 8 to allow the rod-side chamber 5 to communicate with the piston-side chamber 6 and an interrupting position 23*c* for permitting only the flow from the piston-side chamber 6 to the rod-side chamber 5; a spring 23*d* which biases the valve 23*a* to be located at the interruption position 23*c*; and a solenoid 23*e* which switches the valve 23*a* to the communicating position 23*b* against the spring 23*d* in current-carrying.

The second on-off valve 24 provided in the middle of the second passage 10 is composed of a solenoid on-off valve in this embodiment, including a valve 24*a* including a communicating position 24*b* for opening the second passage 10 to allow the piston-side chamber 6 to communicate with the tank 7 and an interrupting position 24*c* for permitting only the flow from the tank 7 to the piston-side chamber 6; a spring 24*d* which biases the valve 24*a* to be located at the interruption position 24*c*; and a solenoid 24*e* which switches the valve 24*a* to the communicating position 24*b* against the spring 24*d* in current-carrying.

According to such a structure, in a state where the first on-off valve 23 is located at the interrupting position 23*c* and the second on-off valve 24 is located at the interrupting position 24*c*, the cylinder device 1*c*, when forcedly extended and contracted by external force, behaves as a damper the damping force of which is adjusted by the variable relief valve 22. More specifically, when the cylinder device 1*c* is extended, the capacity of the piston-side chamber 6 is extended to suck the liquid from the tank 7 through the interrupting position 24*c* of the second on-off value 24, while the rod-side chamber 5 is compressed to discharge the liquid to the tank 7 through the discharge passage 21. The damping force of suppressing the extension of the cylinder device 1*c* is developed by presenting a resistance to this flow of liquid in the discharge passage 21 by the variable relief valve 22. When the cylinder device 1*c* is compressed reversely, the piston-side chamber 6 is compressed to cause the liquid in the piston-side chamber 6 to flow into the extending rod-side chamber 5 through the interrupting position 23*c* of the first on-off valve 23, and the surplus liquid within the cylinder 2 which corresponds to the penetrating volume of the rod 4 into the cylinder 2 is discharged to the tank 7 through the discharge passage 21. The flow of liquid is a one-way flow circulating in order through the piston-side chamber 6, the rod-side chamber 5 and the tank 7, and the damping force of suppressing the compression of the cylinder device 1*c* is developed by presenting a resistance, when the liquid discharged from the cylinder 2 by the extending and contracting operation of the cylinder device 1*c* is passed through the discharge passage 21, to this flow of liquid by the variable relief valve 22. That is, the cylinder device 1*c* behaves as a uniflow damper when both the first on-off valve 23 and the second on-off valve 24 are located at the interrupting positions 23*c* and 24*c*.

In this cylinder device 1*c*, since the valves 23*a* and 24*a* of the first on-off valve 23 and the second on-off valve 24 are pressed by the springs 23*d* and 24*d* and located respectively at the interrupting positions 23*c* and 24*c* in the event of current-carrying failure, and the variable relief valve 22 behaves as a pressure control valve with the valve opening pressure being maximized, the device 1*c* can automatically behave as a passive damper in the event of failure such as current-carrying failure. Since the damping forces generated in both extension and contraction can be equalized, if the piston speed is the same in both the extension and the contraction, by setting the pressure receiving area on the rod-side chamber 5 side in the piston 3 to a half of the pressure receiving area on the piston-side chamber 6 side, the thus-configured cylinder device 1, particularly, can be most suitably applied to a vibration control object having no polarity in vibrating direction such as relative vibrations of a vehicle body and a truck in railroad vehicle.

In this case, namely, the interrupting position 23*c* of the first on-off valve 23 behaves as a flow straightening passage which permits only the flow of liquid from the piston-side chamber 6 to the rod-side chamber 5 in cooperation with the first passage 8, and the interrupting position 24*c* of the second on-off valve 23 behaves as a suction passage which permits only the flow of liquid from the tank 7 to the piston-side chamber 6 in cooperation with the second passage 10. The flow straightening passage may adopt a structure in which a passage allowing the piston-side chamber 6 to communicate with the rod-side chamber 5 is provided independently from the first passage 8 with a check valve being provided in the middle of the passage, although it can be consolidated to the interrupting position 23*c* of the first on-off valve 23 and the first passage 8, and may be provided, for example, on the piston 3. The suction passage may also adopt a structure in which a passage allowing the piston-side chamber 6 to communicate with the tank 7 is provided independently from the second passage 10 with a check valve being provided in the middle of the passage, although it can be consolidated to the interrupting position 24*c* of the second on-off valve 24 and the second passage 10, and may be provided, for example, on the lid 13.

In this cylinder device 1*c*, further, the rod-side chamber 5 is connected to the tank 7 through a limiting passage 25, and an orifice 26 is provided in the middle of the limiting passage 25 to present a resistance to the flow of liquid passing therethrough. When the cylinder device 1*c* is assembled, the cylinder device 1*c* is operated to extend and contract as it is in a uniflow damper state by closing the first on-off valve 23, the second on-off valve 24 and the variable relief valve 22 to circulate the liquid to the cylinder 2 and the tank 7 through the limiting passage 25, whereby deaeration of the cylinder 2 can be performed by discharging liquid with the probability of gas entrapment to the tank 7 and sucking liquid free from the probability of gas entrapment from the tank 7 to the cylinder 2. That is, the limiting passage 25 behaves as a deaerating passage, so that the flow rate passing through the limiting passage 25 is largely limited, in general operation, by the orifice 26 as resistance, and the loss in passage of the liquid through the limiting passage 25 is minimized when the cylinder device 1*c* is caused to function as actuator. When the cylinder device 1*c* behaves as damper in the event of failure, the damping force may be generated by the orifice 26 in cooperation with the variable relief valve 22 and, further, development of damping force can be surely performed by the orifice 26 alone in a state such that the variable relief valve 22 cannot be opened. The above-mentioned limiting passage 25 and orifice 26 can be provided within the circuit of each of the cylinder devices 1, 1*a* and 1*b* of the above-mentioned embodiments.

The cylinder device 1*c* of the other embodiment can be controlled to operate as actuator by the same method as that of the above-mentioned cylinder device 1*b*. That is, the magnitude and direction of thrust may be controlled only by on/off-control of the first on-off valve 23 and the second on-off valve 24, or the direction of thrust may be controlled by the first on-off valve 23 and the second on-off valve 24 while controlling the magnitude of thrust by the torque control of the motor 15, or the direction of thrust is controlled by the first on-off valve 23 and the second on-off valve 24 while controlling the magnitude of thrust by the valve opening pressure of the variable relief valve 22.

When the cylinder device 1*c* is caused to behave as the damper in compressing operation, a desired thrust can be obtained by interrupting the liquid supply from the pump 12 and controlling the valve opening pressure of the variable relief valve 22 with the second on-off valve 24 being at the interrupting position 24*c*. Since the first on-off valve 23 permits the flow of liquid from the piston-side chamber 6 to the rod-side chamber 5 by the interrupting position 23*c*, and allows contraction of the cylinder device 1*c* even when it is located at the interrupting position 23*c*, the first on-off valve 23 can be located at any of the communicating position 23*b* and the interrupting position 23*c* when the cylinder device 1*c* is caused to perfectly behave as a passive damper without skyhook semiactive control which will be described below. Similarly, when the cylinder device 1*c* is caused to behave as the damper in extending operation, a desired thrust can be obtained by interrupting the liquid supply from the pump 12 and controlling the valve opening pressure of the variable relief valve 22 with the first on-off valve 23 being at the interrupting position 23*c*. Since the second on-off valve 24 permits the flow of liquid from the tank 7 to the piston-side chamber 6 by the interrupting position 24*c*, and allows extension of the cylinder device 1*c* even if it is located at the interrupting position 24*c*, the second on-off valve 24 can be located at any of the communicating position 24*b* and the interrupting position 24*c* when the cylinder device 1*c* is caused to perfectly behave as a passive damper without the skyhook semiactive control to be described below.

The cylinder device 1*c* of the other modified example also can fulfill the function as actuator, since the variable relief valve 22 is provided in the middle of the discharge passage 21 allowing the rod-side chamber 5 to communicate with the tank 7, by optionally selecting one of the control methods of the cylinder devices 1, 1*a* and 1*b* of the above-mentioned embodiments. The cylinder device 1*c* can develop various function effects in the cylinder device 1 of the one embodiment described above since it has the same structure of thrust generation as the cylinder device 1 with increased variations of control method.

Additionally, since the magnitude of thrust can be similarly controlled by controlling the valve opening pressure of the variable relief valve 22, the advantage that the thrust of the cylinder device 1*b* can be adjusted without particular sensing only by acquiring the amount of current to be supplied to the proportional solenoid 22*c* and the valve opening pressure can be enjoyed also in this case.

Further, the cylinder device 1*c*, when forcedly extended and contracted by external force, can be caused to behave as a passive uniflow damper without control of the first on-off valve 23 and the second on-off valve 24 since the flow straightening passage and the suction passage are not particularly provided, and can surely develop the damper function in the event of current-carrying failure.

The cylinder device 1*c* can behave as the actuator by driving the pump 12 and also as the damper by stopping the drive of the pump 12 to adjust the thrust through control of the valve opening pressure of the variable relief valve 22. Therefore, this cylinder device can suppress the vibration of the vibration control object not only by the active control by the behavior as actuator but also by the skyhook semiactive control.

In the skyhook semiactive control, when the thrust of the cylinder device 1*c* is minimized in extending operation, the first on-off valve 23 is located at the communicating position 23*b*, and the second on-off valve 24 are located at the interrupting position 24*c*, and when the thrust of the cylinder device 1*c* is minimized in contracting operation, the first on-off valve 23 is located at the interrupting position 23*c*, and the second on-off valve 24 is located at the communicating position 24*b* respectively.

When the skyhook semiactive control is performed, the damping force can be exerted in extending operation to suppress it by locating the first on-off valve 23 at the interrupting position 23*c* and locating the second on-off valve 24 at the communicating position 24*c*, and if only the extending and contracting direction of the cylinder device 1*c* is switched without switching of the vibrating direction of the vibration control object, the damping force of the cylinder device 1*c* is minimized or the vibration control object is never excited since the first on-off valve 23 is at the interrupting position 23*c* and the second on-off valve 24 is at the communicating position 24*c*. In compression operation, to the contrary, the damping force can be exerted to suppress it by locating the first on-off valve 23 at the communicating position 23*b* and locating the second on-off valve 24 at the interrupting position 24*b*, and if only the extending and contracting direction of the cylinder device 1*c* is switched without switching of the vibrating direction of the vibration control object, the damping force of the cylinder device 1*c* is minimized or the vibration control object is never excited since the first on-off valve 23 is at the communicating position 23*c* and the second on-off valve 24 is at the interrupting position 23*b*.

Accordingly, in the cylinder device 1*c* of this embodiment, the operation load on the skyhook semiactive control is reduced, and the control of the first on-off valve 23 and the second on-off valve 24 is simplified, since the control device 1*c* mechanically conforms the damping force to zero in the skyhook semiactive control, without polarity determination by the Carnap's theory when the vibrating direction of the vibration control object is differed from the relative direction of the cylinder device 1.

In this embodiment, further, an outer cylinder 27 is provided on the outer circumference of the cylinder 2, and the tank 7 is provided between the cylinder 2 and the outer cylinder 27. By providing the tank 7 between the cylinder 2 and the outer cylinder 27, the limiting passage 25 and the orifice 26 can be provided in the upper thickness in FIG. 4 of the cylinder 2, whereby when the cylinder device 1*c* is horizontally placed as shown in the drawing, the gas entrapped into the cylinder 2 can be rapidly discharged to the tank 7 to enjoy the advantage that the deterioration in responsiveness of the cylinder device 1*c* can be instantaneously resolved. It is a matter of course that the outer cylinder 27 can be applied to each of the above-mentioned embodiments.

Figure 5:
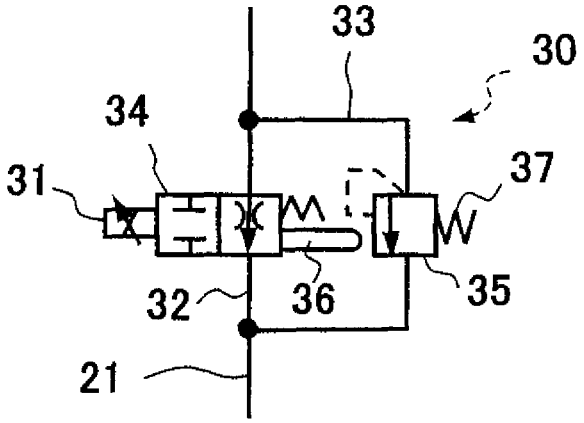
FIG. 5 is a circuit diagram of a variable relief valve.
Figure 6:
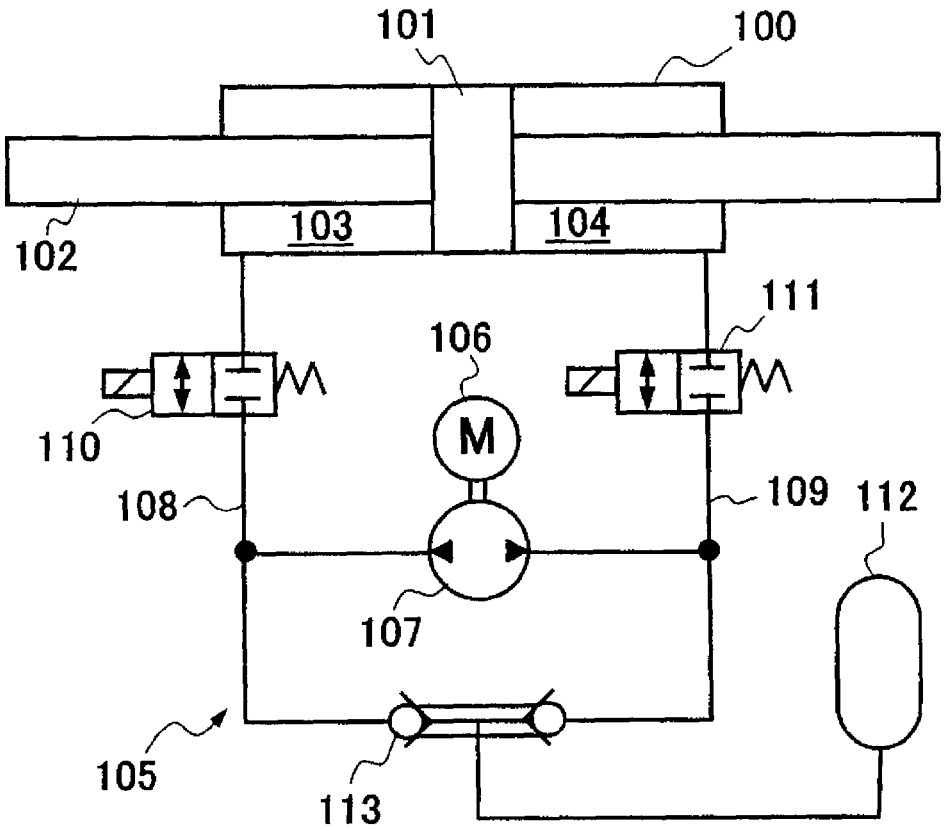
FIG. 6 is a circuit diagram of a cylinder device in the background art.

Further, the variable relief valve 22 in the above-mentioned cylinder devices 1*b* and 1*c* can be changed to a variable relief valve 30 shown in FIG. 5. The variable relief valve 30 of FIG. 5 includes a proportional solenoid 31; a damping passage 32 connected to the middle of the discharge passage 21; a relief passage 33 juxtaposed with the damping passage 32; a selector valve element 34 biased to open the damping passage 32 and set to close the damping passage 32 in current-carrying to a proportional solenoid, the selector valve element presenting a resistance to the flow of liquid when the damping passage is opened; and a relief valve element 35 biased to close the relief passage 33, the valve opening pressure of which is reduced according to the current-carrying amount in the current-carrying to the proportional solenoid.

More specifically, a pushrod 36 extending toward the relief valve element 35 is connected to the selector valve element 34, and when current is carried to the proportional solenoid 31, the selector valve element 34 is pressed by the proportional solenoid 31 and switched to an interrupting position, and the pushrod 36 is allowed to abut on the relief valve element 35, whereby the thrust of the proportional solenoid 31 can be applied onto the relief valve element 35.

Since the thrust of the proportional solenoid 31 acts on the relief valve element 35 oppositely to the spring 37 biasing the relief valve element 35, the valve opening pressure of the relief valve element 35 can be controlled by adjusting the current-carrying amount to the proportional solenoid 31.

That is, when no current is carried to the proportional solenoid 31, the variable relief valve 30 behaves as a throttle valve since the selector valve element 34 opens the damping passage 32 to present a resistance to the flow of hydraulic oil passing therethrough, and the relief valve element 35 with the valve opening pressure being maximized opens the relief passage 33, in response to an excessive input, to fulfill the relief function.

On the other hand, when current is supplied to the proportional solenoid 31, the relief valve element 35 opens the relief valve 33 at the valve opening pressure adjusted according to the current-carrying amount to the proportional solenoid 31, since the selector valve element 34 interrupts the damping passage 32, to fulfill the relief function.

The magnitude of the thrust as actuator of the cylinder devices 1*b* and 1*c* can be controlled also by use of such a proportional solenoid variable relief valve 30 to respond to both the active control and the semiactive control. Further, since this valve behaves as a throttle valve in the event of failure, the cylinder device 1*c*, when this valve is applied to the cylinder device 1*c*, can behave as a passive damper which develops a damping force by the variable relief valve 30 behaving as the throttle valve. Thus, the damping characteristics in the event of failure can be set not to the characteristics of the relief valve but to characteristics depending on various throttle valves, and damping forces further suitable to vibrations of railroad vehicle can be exerted.

Having described the present invention as related to the embodiments, the scope of the present invention is never limited by the details shown in the drawings or described herein.

While specific embodiments of the invention have been described in detail to illustrate the application of the principles of the invention, it will be understood that the invention may be embodied otherwise without departing from such principles.

INDUSTRIAL USABILITY

The present invention can be applied to, for example, cylinder devices to be mounted on various vehicles including railroad vehicle.

The invention claimed is:

1. A cylinder device comprising:

a cylinder;

a piston slidably inserted into the cylinder;

a rod inserted into the cylinder and connected to the piston;

a rod-side chamber and a piston-side chamber partitioned by the piston within the cylinder;

a tank;

a first on-off valve provided in the middle of a first passage allowing the rod-side chamber to communicate with the piston-side chamber;

a second on-off valve provided in the middle of a second passage allowing the piston-side chamber to communicate with the tank;

a pump for supplying liquid to the rod-side chamber;

a discharge passage to connect the rod-side chamber to the tank;

a variable relief valve capable of changing valve opening pressure, said variable relief valve being provided in the middle of the discharge passage;

a suction passage permitting only the flow of liquid from the tank to the piston-side chamber; and a flow straightening passage permitting only the flow of liquid from the piston-side chamber to the rod-side chamber, said variable relief valve being composed of a solenoid variable relief valve capable of adjusting the valve opening pressure by a proportional solenoid, said variable relief valve including the proportional solenoid, a damping passage connected to the middle of the discharge passage, a relief passage juxtaposed with the damping passage, a selector valve element biased to open the damping passage and set to close the damping passage in current-carrying to the proportional solenoid, and a relief valve element biased to close the relief passage, the valve opening pressure of the relief valve element being reduced according to the current-carrying amount in the current-carrying to the proportional solenoid, the selector valve element providing a resistance to the flow of liquid when the damping passage is opened, wherein thrust is controlled by controlling the valve opening pressure of the variable relief valve.

2. A cylinder device according to claim 1, wherein the second on-off valve is opened and closed, in an extending operation for protruding the rod from the cylinder by the liquid supplied from the pump, while maintaining the first on-off valve in an opened state to thereby control the thrust in the extending direction, while the first on-off valve is opened and closed, in a compressing operation for penetrating the rod into the cylinder by the liquid supplied from the pump, while maintaining the second on-off valve in an opened state to thereby control the thrust in the compressing direction.

3. A cylinder device according to claim 1, wherein the pump is driven by a motor, and the thrust is controlled by controlling the torque of the motor.

4. A cylinder device according to claim 1, further comprising a limiting flow passage connecting the rod-side chamber to the tank and comprising an orifice provided in the middle thereof.

5. A cylinder device according to claim 1, wherein a check valve is provided between the pump and the rod-side chamber to arrest the flow of liquid from the rod-side chamber to the pump.

6. A cylinder device according to claim 1, wherein the tank is formed by an annular gap between the cylinder and an outer cylinder covering the cylinder.

7. A cylinder device according to claim 1, wherein each of the first on-off valve and the second on-off valve is composed of a solenoid on-off valve, which is located at an interrupting position by a spring in no-current carrying, and a valve opening pressure of said variable relief valve is maximized in no-current carrying.

8. A cylinder device according to claim 1, wherein said pump is connected to a supply passage, at least a portion of said supply passage being connected to said rod-side chamber in a first area of said rod-side chamber, at least a portion of said first passage being connected to said rod-side chamber in a second area of said rod-side chamber, said first area being located at a spaced location from said second area.

9. A cylinder device comprising:

a cylinder;

a piston slidably inserted into the cylinder;

a rod inserted into the cylinder and connected to the piston;

a rod-side chamber and a piston-side chamber partitioned by the piston within the cylinder;

a tank;

a first on-off valve connected at a position along a first passage to allow the rod-side chamber to communicate with the piston-side chamber;

a second on-off valve connected at a position along a second passage to allow the piston-side chamber to communicate with the tank;

a pump for supplying liquid to the rod-side chamber;

a discharge passage to connect the rod-side chamber to the tank;

a variable relief valve capable of changing valve opening pressure, said variable relief valve being connected at a position along the discharge passage, said pump being connected to a supply passage, at least a portion of said supply passage being connected to said rod-side chamber in a first area of said rod-side chamber, at least a portion of said first passage being connected to said rod-side chamber in a second area of said rod-side chamber, said first area being located at a spaced location from said second area.

* * * * *